US008385567B2

(12) United States Patent
Akino

(10) Patent No.: US 8,385,567 B2
(45) Date of Patent: Feb. 26, 2013

(54) CONDENSER MICROPHONE AND METHOD FOR FIXING MICROPHONE CABLE

(75) Inventor: Hiroshi Akino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 455 days.

(21) Appl. No.: 12/805,078

(22) Filed: Jul. 12, 2010

(65) Prior Publication Data

US 2011/0013801 A1 Jan. 20, 2011

(30) Foreign Application Priority Data

Jul. 14, 2009 (JP) ..... 2009-165477

(51) Int. Cl.
*H04R 25/00* (2006.01)

(52) U.S. Cl. ..... 381/174; 381/355; 381/361

(58) Field of Classification Search ..... 381/111, 381/113, 355, 174, 361
See application file for complete search history.

(56) References Cited

U.S. PATENT DOCUMENTS

| | | | | |
|---|---|---|---|---|
| 7,088,839 | B2 * | 8/2006 | Geschiere et al. | 381/368 |
| 2004/0236176 | A1 * | 11/2004 | Asnes | 600/25 |
| 2010/0316243 | A1 * | 12/2010 | Akino | 381/361 |
| 2011/0142264 | A1 * | 6/2011 | Akino | 381/174 |

* cited by examiner

*Primary Examiner* — Jeffrey Donels
(74) *Attorney, Agent, or Firm* — Manabu Kanesaka

(57) ABSTRACT

There is provided a condenser microphone of a type such that a microphone cable is directly drawn into a microphone casing, in which the electromagnetic shieldability of a microphone cable draw-in portion can be enhanced, and the microphone cable can be fixed easily. In a condenser microphone in which a microphone cable 20 is directly drawn into a microphone casing 10 formed with a cable insertion hole 12 in an end wall 11, a gel-form ferrite sheet 30 having a cable insertion hole 31 having an outside diameter approximately equal to the inside diameter of the microphone casing 10 and formed coaxially with the cable insertion hole 12 is disposed along the inner surface of the end wall 11 in the microphone casing 10, and after the microphone cable 20 has been inserted through the cable insertion holes 12 and 31, the gel-form ferrite sheet 30 is pressed toward the end wall 11 by a predetermined pressing means 40 to reduce the diameter of the second cable insertion hole 31 and to cause the gel-form ferrite sheet 30 to adhere closely to the microphone cable 20, whereby the microphone cable 20 is fixed.

4 Claims, 1 Drawing Sheet

CONDENSER MICROPHONE AND METHOD FOR FIXING MICROPHONE CABLE

CROSS-REFERENCE TO RELATED APPLICATION

The present application is based on, and claims priority from, Japanese Application Serial Number JP2009-165477, filed Jul. 14, 2009, the disclosure of which is hereby incorporated by reference herein in its entirety.

TECHNICAL FIELD

The present invention relates to a condenser microphone of a type such that a microphone cable is drawn therein from one end part side of a microphone casing. More particularly, it relates to a technique for enhancing the electromagnetic shieldability of a microphone cable draw-in portion and for fixing the microphone cable easily.

BACKGROUND ART

For the condenser microphone, an electrostatic acoustic-electric converter provided in a microphone unit has a very high impedance. Therefore, the microphone incorporates an electronic circuit for producing a sound signal including an impedance converter. As the impedance converter, a field effect transistor (FET) has usually been used.

The electronic circuit is accommodated in a shielded space formed by a metallic microphone casing. If the shield is incomplete, a high-frequency current caused by external electromagnetic waves (especially, strong electromagnetic waves emitted from a cellular phone) flows into the microphone casing, and is detected by the impedance converter, whereby noise of an audible frequency may be generated.

In particular, for a microphone of a type such that a microphone cable is directly drawn into the microphone casing, such as a tie clip microphone or a gooseneck microphone, the shield in a microphone cable draw-in portion becomes incomplete easily (for example, refer to Japanese Patent Application Publication No. 2006-128850).

On the other hand, for the microphone of the type such that the microphone cable is directly drawn into the microphone casing, as measures against a pulling external force applied to the microphone cable, as described, for example, in Japanese Patent Application Publication No. 2006-19854, a knot of microphone cable is generally formed in the microphone casing.

However, the above-described measures are not favorable as the measures against external electromagnetic waves because the formation of the knot increases the wiring length of the microphone cable in the microphone casing.

An object of the present invention is to provide a condenser microphone of a type such that a microphone cable is directly drawn into a microphone casing, in which the electromagnetic shieldability of a microphone cable draw-in portion can be enhanced, and the microphone cable can be fixed easily.

SUMMARY OF THE INVENTION

To achieve the above object, the present invention provides a condenser microphone including a microphone casing that consists of a metallic cylindrical body formed with a first cable insertion hole in an end wall thereof and accommodates a sound signal output circuit therein, in which a microphone cable connected to the sound signal output circuit is drawn into the microphone casing through the first cable insertion hole, wherein a gel-form ferrite sheet having a second cable insertion hole formed coaxially with the first cable insertion hole is disposed along the inner surface of the end wall in the microphone casing, and the microphone cable is drawn into the microphone casing through the first and second cable insertion holes.

In the present invention, it is preferable that the gel-form ferrite sheet be formed so that the outside diameter thereof is approximately equal to the inside diameter of the microphone casing, and in the microphone casing, there be provided a pressing means that presses the gel-form ferrite sheet toward the end wall so that the diameter of the second cable insertion hole is reduced, and the gel-form ferrite sheet adheres closely to the microphone cord.

According to a preferred mode of the present invention, as the pressing means, a belleville spring is used which has an outside diameter larger than the inside diameter of the microphone casing and the peripheral edge part of which is elastically deformed so that the belleville spring can be locked to the inner peripheral surface of the microphone casing.

The present invention also embraces a method for fixing a microphone cable. That is, the present invention provides a method for fixing a microphone cable in a condenser microphone in which the microphone cable drawn through a first cable insertion hole is fixed in a microphone casing consisting of a metallic cylindrical body and formed with the first cable insertion hole in an end wall thereof, wherein a gel-form ferrite sheet having an outside diameter approximately equal to the inside diameter of the microphone casing and having a second cable insertion hole formed coaxially with the first cable insertion hole is disposed along the inner surface of the end wall in the microphone casing, and after the microphone cable has been inserted through the first and second cable insertion holes, the gel-form ferrite sheet is pressed toward the end wall by a predetermined pressing means to reduce the diameter of the second cable insertion hole and to cause the gel-form ferrite sheet to adhere closely to the microphone cable, whereby the microphone cable is fixed.

According to the present invention, since the gel-form ferrite sheet is disposed around the microphone cable drawn into the microphone casing, the electromagnetic shieldability of a microphone cable draw-in portion can be enhanced, and a high-frequency current, which is a noise source, can be inhibited from intruding into the microphone casing.

Also, since the gel-form ferrite sheet is pressed by the predetermined pressing means to reduce the diameter of the cable insertion hole therein (the second cable insertion hole) and to cause the gel-form ferrite sheet to adhere closely to the microphone cable, the microphone cable can be fixed. That is, the gel-form ferrite sheet can inhibit a high-frequency current, which is a noise source, from intruding into the microphone casing, and also can fix the microphone casing easily.

DETAILED DESCRIPTION

An embodiment of the present invention will now be described with reference to FIGS. 1 to 3. The present invention is not limited to this embodiment.

Figure 1:
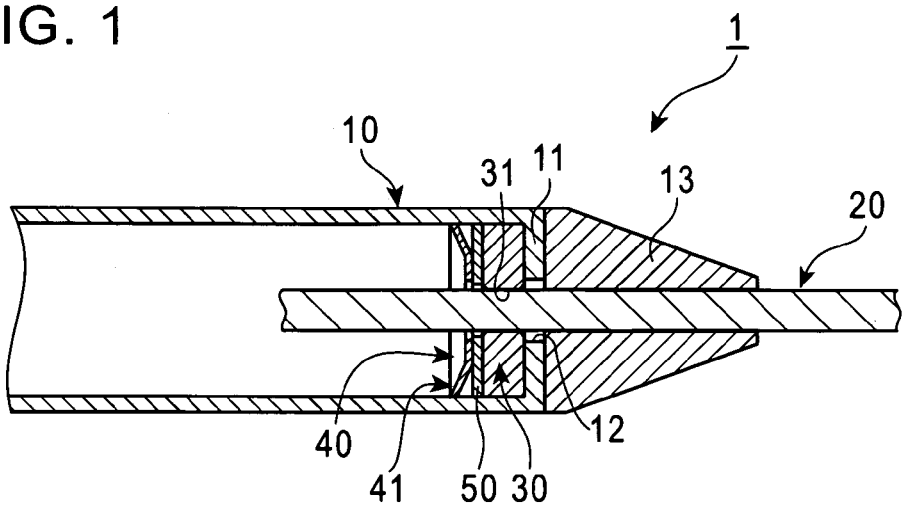
FIG. 1 is sectional view showing an essential portion of a condenser microphone in accordance with an embodiment of the present invention.

As shown in FIG. 1, a condenser microphone 1 is provided with a microphone casing 10 formed of a metallic material such as a brass alloy.

The microphone casing 10 is of a cylindrical shape, and has an end wall 11 on one end side thereof. The end wall 11 is penetratingly provided with a cable insertion hole (first cable insertion hole) 12 for drawing a microphone cable 20 in the microphone casing 10. On the outer surface side of the end wall 11, a cable bush 13 formed of a rubber material or the like is provided.

Although not shown in the figure, in this embodiment, on the other end side of the microphone casing 10, a microphone unit having an electrostatic acoustic-electric converter is mounted, and in the microphone casing 10, a sound signal output circuit including a field effect transistor (FET) and the like for the microphone unit is accommodated.

The microphone unit may also be configured so as to separate from the microphone casing 10, and be electrically connected to the sound signal output circuit in the microphone casing 10 via another microphone cable different from the above-described microphone cable 20.

According to the present invention, a gel-form ferrite sheet 30 is disposed along the inner surface of the end wall 11 in the microphone casing 10.

The gel-form ferrite sheet 30 is penetratingly provided with a cable insertion hole (second cable insertion hole) 31 coaxially with the cable insertion hole 12 in the end wall 11. The microphone cable 20 is drawn into the microphone casing 10 through these cable insertion holes 12 and 31.

By disposing the gel-form ferrite sheet 30 around the microphone cable 20 as described above, like ferrite beads, a high-frequency current can be inhibited from intruding into the microphone casing 10. As the gel-form ferrite sheet 30 applicable to the present invention, for example, article name GE45 series manufactured by FDK Corporation is available.

In the present invention, the gel-form ferrite sheet 30 is also used as a means for fixing the microphone cable 20.

Figure 2:
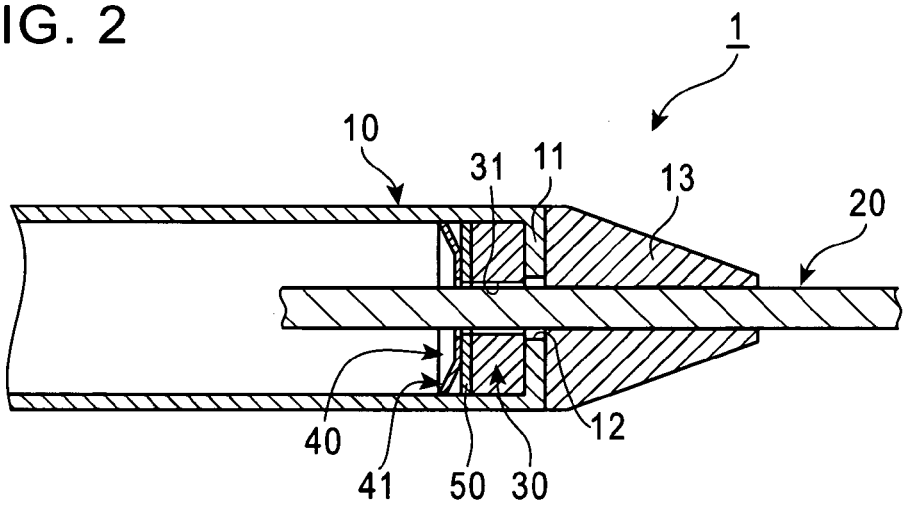
FIG. 2 is sectional view for explaining a method for fixing a microphone cable in the condenser microphone shown in FIG. 1.

Referring to FIG. 2 additionally, the gel-form ferrite sheet 30 is formed in a disc shape having an outside diameter approximately equal to the inside diameter of the microphone casing 10 and is disposed on the inner surface of the end wall 11, and the microphone cable 20 is drawn into the microphone casing 10 through the cable insertion holes 12 and 31.

Next, a washer 50 is attached to the gel-form ferrite sheet 30, and the gel-form ferrite sheet 30 is pressed toward the end wall 11 via the washer 50 by a pressing means 40 from the inside of the microphone casing 10.

At this time, since the outer peripheral edge of the gel-form ferrite sheet 30 is held by the inner peripheral surface of the microphone casing 10, the gel-form ferrite sheet 30 expands to the inside diameter side, so that as shown in FIG. 1, the diameter of the cable insertion hole 31 is reduced, and the gel-form ferrite sheet 30 adheres closely to the microphone cable 20. Thereby, the microphone cable 20 is fixed.

Figure 3:
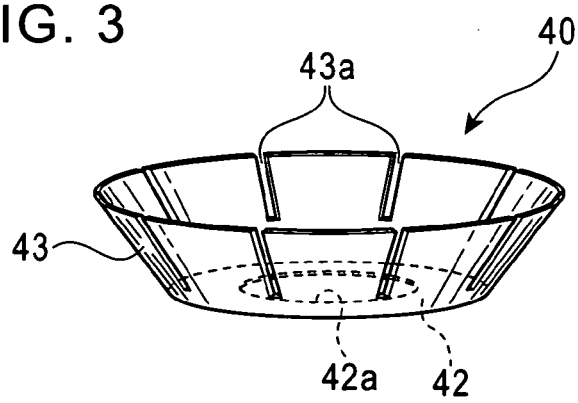
FIG. 3 is a perspective view of a belleville spring used as a pressing means.

The pressing means 40 is preferably a belleville spring 41 shown in FIG. 3. The belleville spring 41 includes a doughnut plate shaped base plate 42 having a center hole 42*a* the diameter of which is larger than that of the cable insertion hole 31, and a flange 43 formed integrally with the base plate 42 so as to have a conical shape the diameter of which decreases gradually from the outer peripheral edge of the base plate 42.

The diameter on the free end side of the flange 43 is larger than the inside diameter of the microphone casing 10, and a plurality of slit grooves 43*a* are formed, for ease of elastic deformation, from the free end side toward the base plate 42 side, preferably at equal intervals.

According to this belleville spring 41, by pushing the belleville spring 41 into the microphone casing 10 so that the base plate 42 comes into contact with the washer 50, the flange 43 is locked to the inner peripheral surface of the microphone casing 10 and functions as a detent. Therefore, merely by pushing the belleville spring 41 into the microphone casing 10, a predetermined pressing force can be applied to the gel-form ferrite sheet 30.

In the above-described embodiment, the washer 50 is used to apply a uniform pressing force to the gel-form ferrite sheet 30. However, the washer 50 may be omitted if the base plate 42 of the belleville spring 41 has a large diameter. Also, as another mode, the washer 50 may be integrated with the base plate 42 of the belleville spring 41 by welding or the like means.

The invention claimed is:

1. A condenser microphone comprising a microphone casing which consists of a metallic cylindrical body formed with a first cable insertion hole in an end wall thereof and accommodates a sound signal output circuit therein, in which a microphone cable connected to the sound signal output circuit is drawn into the microphone casing through the first cable insertion hole, wherein a gel-form ferrite sheet having a second cable insertion hole formed coaxially with the first cable insertion hole is disposed along the inner surface of the end wall in the microphone casing, and the microphone cable is drawn into the microphone casing through the first and second cable insertion holes.

2. The condenser microphone according to claim 1, wherein the gel-form ferrite sheet is formed so that the outside diameter thereof is approximately equal to the inside diameter of the microphone casing, and in the microphone casing, there is provided a pressing means which presses the gel-form ferrite sheet toward the end wall so that the diameter of the second cable insertion hole is reduced, and the gel-form ferrite sheet adheres closely to the microphone cord.

3. The condenser microphone according to claim 1, wherein the pressing means consists of a belleville spring which has an outside diameter larger than the inside diameter of the microphone casing and the peripheral edge part of which is elastically deformed so that the belleville spring can be locked to the inner peripheral surface of the microphone casing.

4. A method for fixing a microphone cable in a condenser microphone in which the microphone cable drawn through a first cable insertion hole is fixed in a microphone casing consisting of a metallic cylindrical body and formed with the first cable insertion hole in an end wall thereof, wherein a gel-form ferrite sheet having an outside diameter approximately equal to the inside diameter of the microphone casing and having a second cable insertion hole formed coaxially with the first cable insertion hole is disposed along the inner surface of the end wall in the microphone casing, and after the microphone cable has been inserted through the first and second cable insertion holes, the gel-form ferrite sheet is pressed toward the end wall by a predetermined pressing means to reduce the diameter of the second cable insertion hole and to cause the gel-form ferrite sheet to adhere closely to the microphone cable, whereby the microphone cable is fixed.

* * * * *